US009054455B2

(12) United States Patent
Llewellyn, III

(10) Patent No.: US 9,054,455 B2
(45) Date of Patent: Jun. 9, 2015

(54) PLUG PULLER

(71) Applicant: Sidney J. Llewellyn, III, Charlotte, NC (US)

(72) Inventor: Sidney J. Llewellyn, III, Charlotte, NC (US)

(73) Assignee: Sidney J. Llewellyn, III, Charlotte, NC (US)

( * ) Notice: Subject to any disclaimer, the term of this patent is extended or adjusted under 35 U.S.C. 154(b) by 37 days.

(21) Appl. No.: 13/970,770

(22) Filed: Aug. 20, 2013

(65) Prior Publication Data

US 2015/0056831 A1 Feb. 26, 2015

(51) Int. Cl.
*H01R 13/633* (2006.01)

(52) U.S. Cl.
CPC ..... *H01R 13/6335* (2013.01)

(58) Field of Classification Search
CPC ..... H01R 13/6335
USPC ..... 439/484, 923, 160
See application file for complete search history.

(56) References Cited

U.S. PATENT DOCUMENTS

| | | | | | |
|---|---|---|---|---|---|
| 1,618,723 | A | * | 2/1927 | Pearson | 439/483 |
| 1,677,622 | A | * | 7/1928 | Dreuil | 439/483 |
| 1,749,623 | A | * | 3/1930 | Zinman | 439/484 |
| 1,765,035 | A | * | 6/1930 | Stubbs | 439/447 |
| 2,438,143 | A | * | 3/1948 | Brown | 191/12 R |
| 2,977,564 | A | * | 3/1961 | Civitelli et al. | 439/160 |
| 2,986,719 | A | * | 5/1961 | Adams | 439/152 |
| 3,008,115 | A | * | 11/1961 | Oakes | 439/160 |
| 3,160,947 | A | * | 12/1964 | Sunderlin | 29/764 |
| 3,431,535 | A | * | 3/1969 | Munyon | 439/484 |
| 4,042,292 | A | * | 8/1977 | Chensky | 439/160 |
| 4,210,377 | A | * | 7/1980 | La Voque | 439/484 |
| 4,850,886 | A | * | 7/1989 | Berke | 439/152 |
| 5,062,803 | A | * | 11/1991 | Howard et al. | 439/160 |
| 5,409,397 | A | * | 4/1995 | Karman | 439/484 |
| 5,516,305 | A | * | 5/1996 | Haluska | 439/484 |
| 5,586,906 | A | * | 12/1996 | Staros et al. | 439/483 |
| 5,690,508 | A | * | 11/1997 | Atkinson | 439/484 |
| 5,752,850 | A | * | 5/1998 | Ziegler | 439/484 |
| D404,984 | S | * | 2/1999 | Skinner | D8/14 |
| 6,659,793 | B1 | * | 12/2003 | Chung et al. | 439/483 |
| 6,726,494 | B1 | * | 4/2004 | Tai et al. | 439/160 |
| 6,733,323 | B2 | * | 5/2004 | Tso-Chin | 439/484 |
| 7,625,230 | B2 | * | 12/2009 | Boerner | 439/484 |
| D639,248 | S | * | 6/2011 | Thornton | D13/154 |
| D648,678 | S | * | 11/2011 | Thornton | D13/138.2 |
| 2003/0194903 | A1 | * | 10/2003 | Tso-Chin | 439/484 |
| 2009/0042425 | A1 | * | 2/2009 | Boerner | 439/160 |
| 2014/0206214 | A1 | * | 7/2014 | Xiao et al. | 439/160 |

* cited by examiner

*Primary Examiner* — Ross Gushi
(74) *Attorney, Agent, or Firm* — Nelson Mullins Riley & Scarborough LLP

(57) ABSTRACT

A plug puller for removing an electrical plug from an outlet, including an elongate sheet of flexible dielectric material defining first and second opposing ends, grasping elements proximate the first and second opposing ends of the elongate sheet, at least one plug opening positioned between the opposing ends for being placed around prongs of the electrical plug and held in place on the plug while the plug is inserted in the outlet, and the opposing ends adapted for being moved between a first position extended outwardly away from each other and a second, removal position with the opposing ends folded towards each other for being grasped and pulled away from the outlet to remove the plug. A related method is also disclosed.

5 Claims, 5 Drawing Sheets

PLUG PULLER

TECHNICAL FIELD AND BACKGROUND OF THE INVENTION

The present invention relates to a device for assisting in removing an electrical plug from an electrical outlet. The invention has particular but not exclusive application in the removal of heavy-duty 200V-type plugs of various designs and configurations from 200V outlets of the type used for heavy duty and commercial appliances, equipment and tools, such as dryers, deep fat fryers and manufacturing equipment that require 220V current to operate. These plugs have three prongs that fit into complementary holes in the outlet. Due to their length and dimensions they typically are tightly held in the outlet and are by design difficult to remove. In many instances the plug is made of a smooth plastic material without surface features that permit a user to obtain a firm secure grip on the plug. The user may, therefore, insert some object such as a knife blade or screwdriver between the plug and the outlet in an effort to pry the plug out of the outlet, or may curl the fingers of the hand under the plug as it pulls away from the outlet in order to obtain a better grip.

Either approach may result in an electrical shock or even electrocution, particularly if the user is not grounded and is standing on a damp surface.

SUMMARY OF THE INVENTION

It is therefore an object of the present invention to provide a simple, inexpensive and safe means of removing an electrical plug from an electrical outlet.

These and other objects and advantages of the invention are achieved by providing a plug puller for removing an electrical plug from an outlet that includes an elongate sheet of flexible dielectric material defining first and second opposing ends, grasping elements proximate the first and second opposing ends of the elongate sheet and at least one plug opening positioned between the opposing ends for being placed around prongs of the electrical plug and held in place on the plug while the plug is inserted in the outlet. The opposing ends are adapted for being moved between a first position extended outwardly away from each other and a second, removal position with the opposing ends folded towards each other for being grasped and pulled away from the outlet to remove the plug.

According to another embodiment of the invention, the plug opening has three plug openings sized and shaped to fit over a plug having complementary sized and shaped prongs.

According to another embodiment of the invention, the plug opening comprises a single plug opening sized and shaped to fit over and surround the prongs of a plug having complementary sized and shaped prongs.

According to another embodiment of the invention, the plug opening comprises a single opening sized and shaped to fit over and surround the prongs of a plug having complementary sized and shaped prongs, and further wherein the plug opening communicates with one edge of the plug puller to form a notch, and is adapted to be wedged between the plug and the outlet when the plug is to be removed.

According to another embodiment of the invention, the elongate sheet of flexible dielectric material comprises high density polyethylene.

According to another embodiment of the invention, the grasping elements comprise respective finger hold openings formed in the elongate sheet.

According to another embodiment of the invention, the at least one plug opening is adapted to fit around the prongs of a 220V plug.

According to another embodiment of the invention, the elongate sheet of flexible dielectric material is high density polyethylene having a thickness of approximately 2 mm.

According to another embodiment of the invention, the elongate sheet is about 38 cm long, 6.5 cm wide at its center and 9 cm wide at its widest points proximate the opposing ends.

According to another embodiment of the invention, a plug puller for removing an electrical plug from an outlet includes an elongate sheet of flexible dielectric material formed of high density polyethylene having a thickness of approximately 2 mm defining first and second opposing ends, first and second finger hold openings proximate the respective first and second opposing ends of the elongate sheet, and at least one plug opening adapted to fit around the prongs of a 220V plug positioned between the opposing ends for being placed around prongs of the 220V plug and held in place on the plug while the plug is inserted in the outlet. The opposing ends are adapted for being moved between a first position extended outwardly away from each other and a second, removal position with the opposing ends folded towards each other for being grasped and pulled away from the outlet to remove the plug.

According to another embodiment of the invention, a method of removing an electrical plug from an outlet is provided and includes the steps of providing an elongate sheet of flexible dielectric material defining first and second opposing ends, grasping elements proximate the first and second opposing ends of the elongate sheet, and at least one plug opening positioned between the opposing ends, placing the at least one plug opening around prongs of the electrical plug, moving the opposing ends between a first position extended outwardly away from each other and a second, removal position with the opposing ends folded towards each other, and grasping the plug puller with the grasping elements and pulling the plug puller away from the outlet to remove the plug.

According to another embodiment of the invention, the method includes the step of inserting the plug into the outlet with the plug puller positioned between the plug and the outlet.

According to another embodiment of the invention, the step of placing the at least one plug opening around prongs of the electrical plug includes the step of wedging the plug puller between the plug and the outlet.

BRIEF DESCRIPTION OF THE DRAWING FIGURES

The present invention is best understood when the following detailed description of the invention is read with reference to the accompanying drawings, in which.

DETAILED DESCRIPTION OF THE PREFERRED EMBODIMENT

Figure 2:
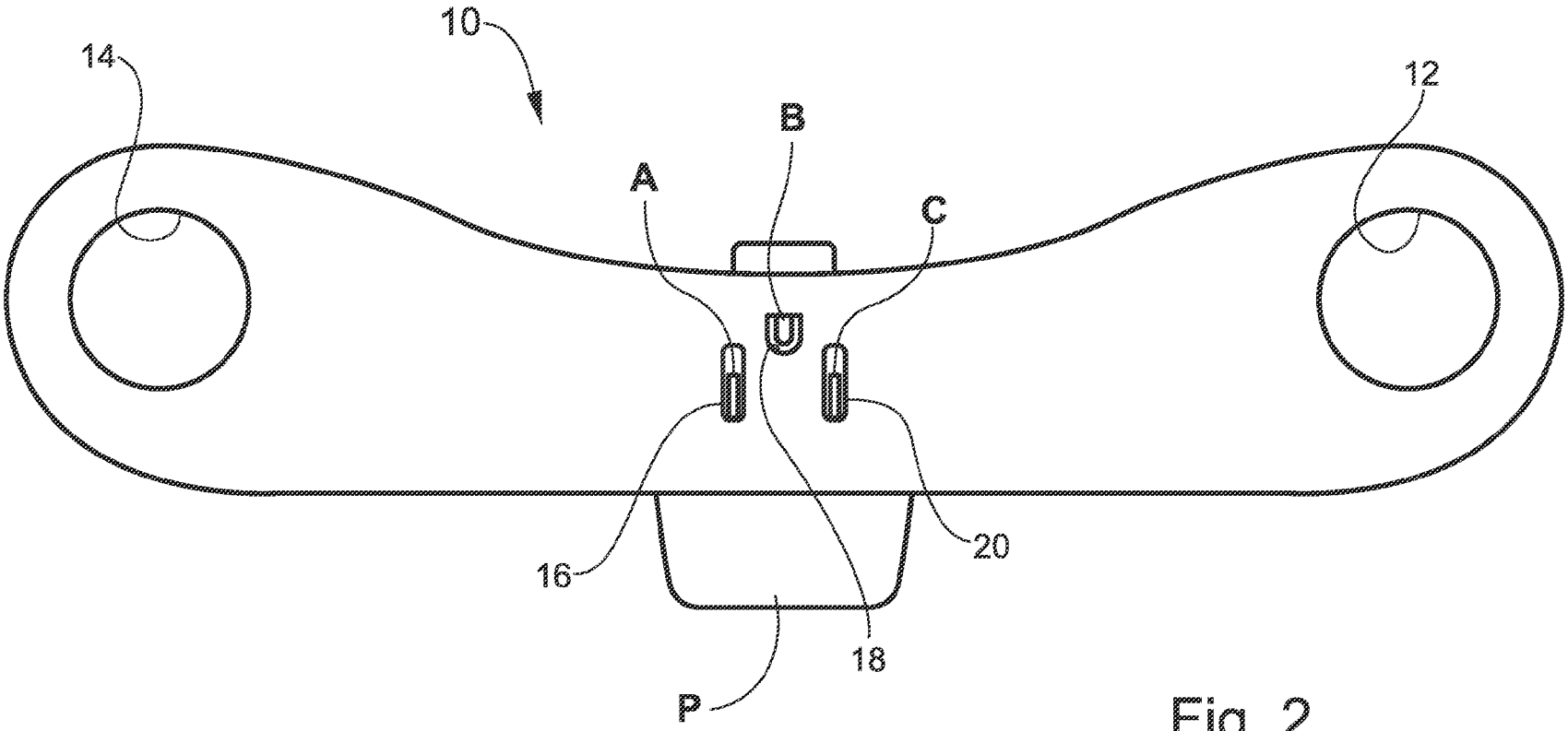
FIG. 2 is a plan view of the plug puller of FIG. 1 in place on a typical 220V electrical plug.
Figure 3:
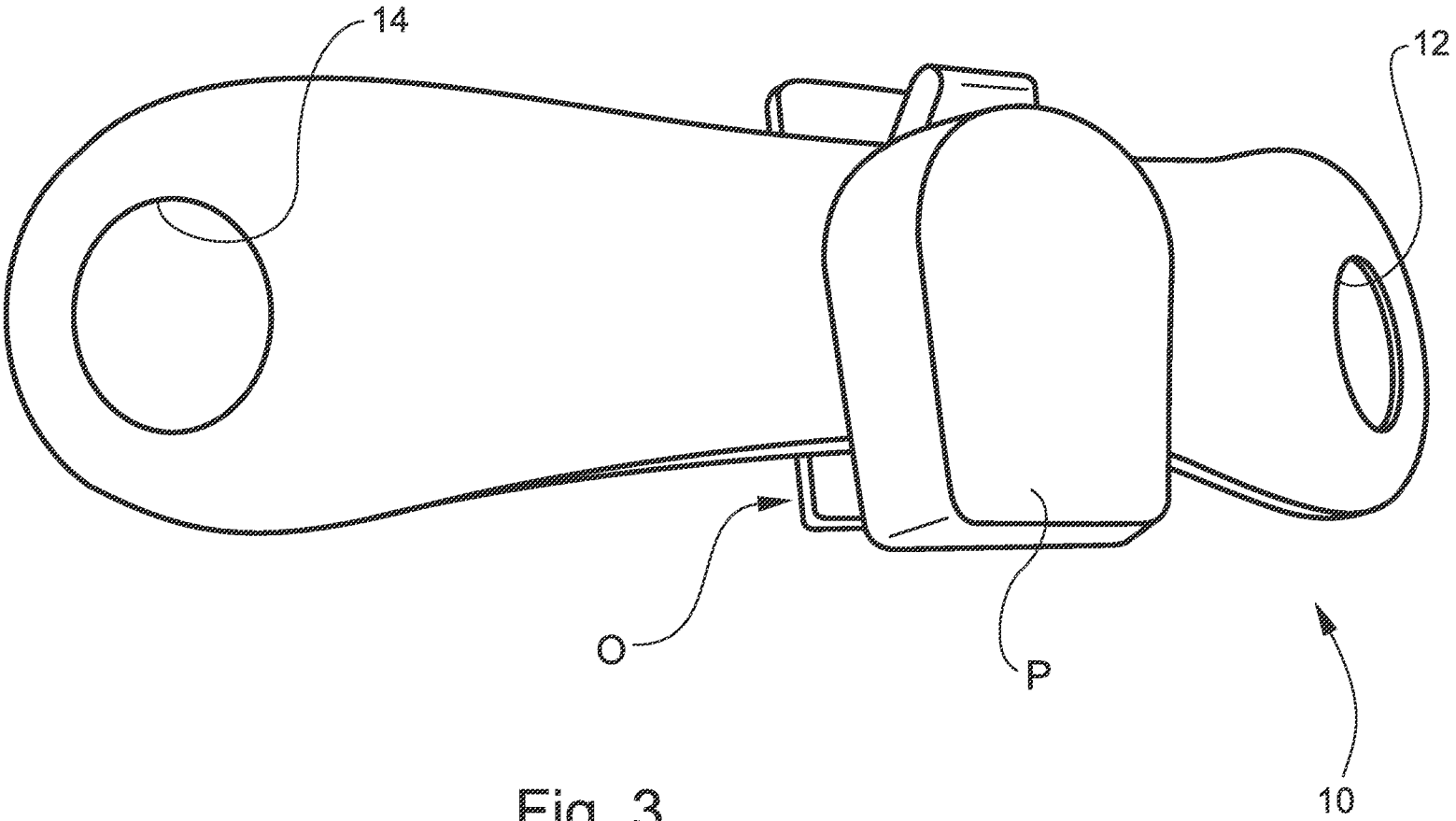
FIG. 3 is a perspective view of the plug puller in place between a typical 220V electrical plug and a complementary 220V electrical outlet.

Referring now specifically to the drawings, a plug puller according to one preferred embodiment of the invention is shown and indicated at broad reference numeral 10. The plug puller 10 is preferably constructed of a length of flexible dielectric material. One suitable material is high density polyethylene (HDPE) sheet material. The plug puller 10 includes a pair of finger hold openings 12, 14 near the opposite ends, and openings 16, 18, 20 spaced equally between the finger hold openings 12, 14 that are sized and spaced to fit over the prongs A, B and C of a predetermined specific design of an electrical plug P, as shown in FIG. 2. After the plug puller 10 is placed over the prongs A, B, C, the plug P is inserted into an outlet O in the usual manner, as shown in FIG. 3. The plug puller 10 remains between the plug P and the outlet O at all times when the plug P is inserted in the outlet O and is available for use whenever the plug P must be removed.

Figure 1:
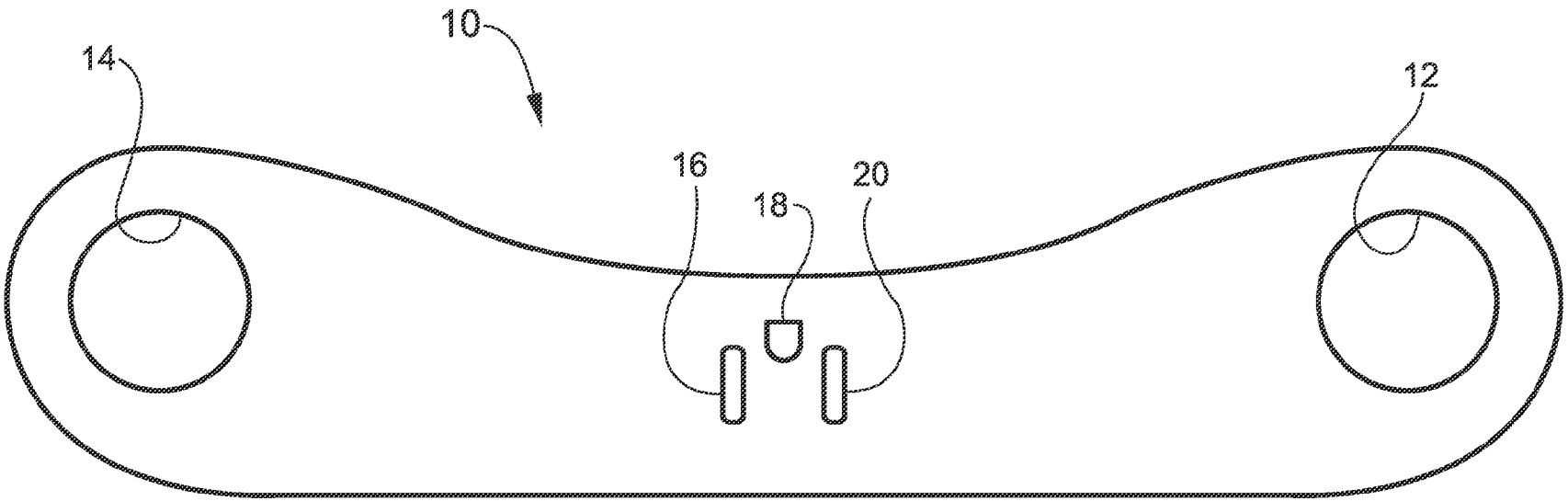
FIG. 1 is a plan view of a plug puller according to one embodiment of the invention.
Figure 4:
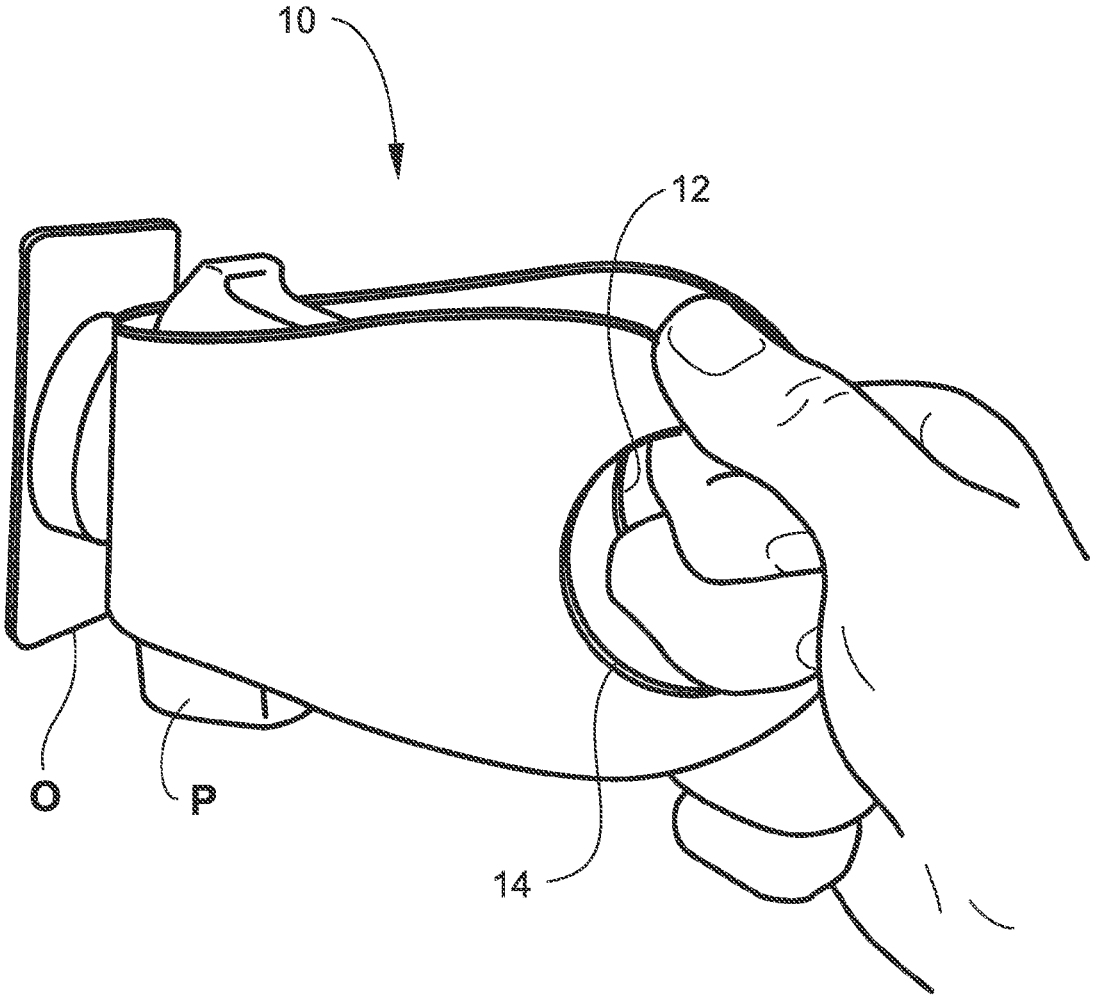
FIG. 4 is a perspective view of the plug puller in its use position being pulled outwardly by a user to remove the plug from the outlet.

In the particular embodiment shown in FIGS. 1, 2 and 3, the overall length of the plug puller 10 is 38 cm, with a width through the center of 6.5 cm, a width through the hand hold openings 12, 14 of 9 cm and a thickness of approximately 2 mm (1/16 in). This thickness in an HDPE material is thin enough not to interfere with a proper electrical connection between the plug P and the outlet O, but thick enough to provide ample strength when pulling the plug P from the outlet O as shown in FIG. 4. This preferred thickness also provides sufficient flexibility to permit the plug puller 10 to be closed on itself, also as shown in FIG. 4.

Figure 5:
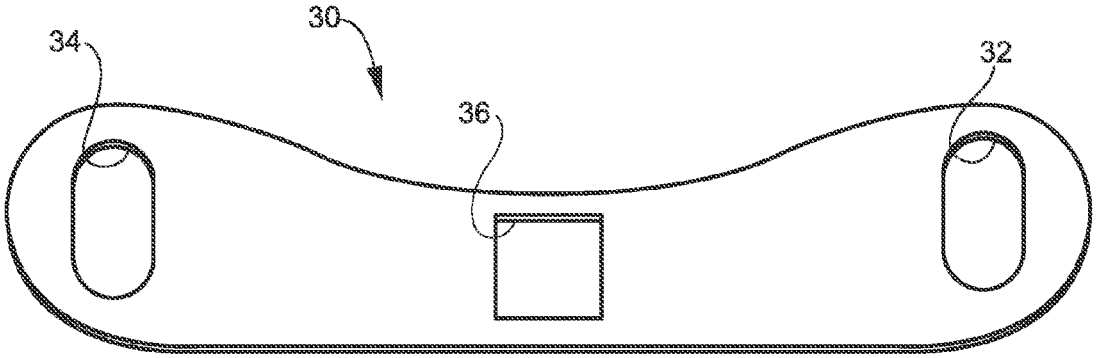
FIG. 5 is a plan view of another embodiment of a plug puller according to one embodiment of the invention.
Figure 6:
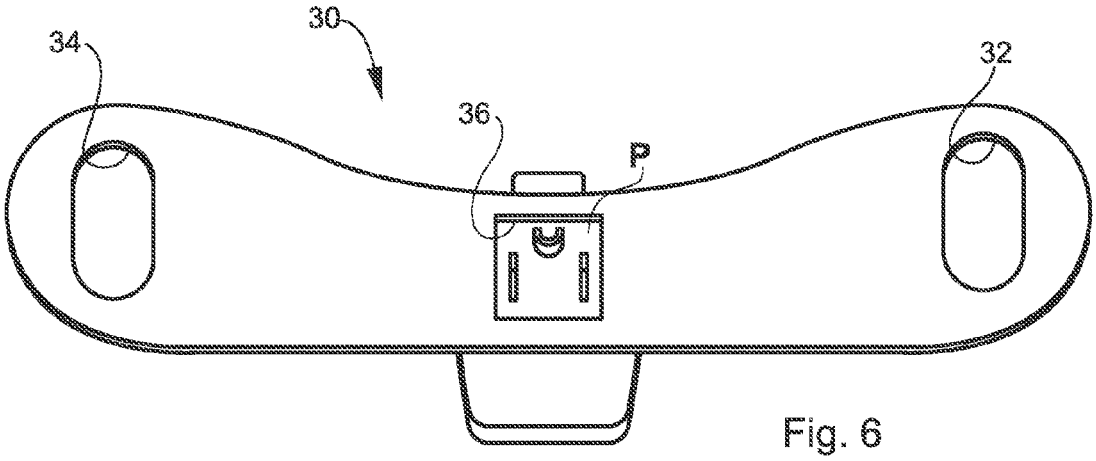
FIG. 6 is a plan view of the plug puller of FIG. 5 in place on a typical 220V electrical plug.

Referring now to FIG. 5, an alternate plug puller is shown at reference numeral 30, and is fabricated from a length of flexible dielectric material. One suitable material is high density polyethylene (HDPE) sheet material, as with the plug puller 10 of FIG. 1. The plug puller 30 includes a pair of finger hold openings 32, 34 near the opposite ends, and a central opening 36 spaced equally between the finger hold openings 12, 14. The opening 36 is sized and spaced to fit around the prongs A, B and C of a predetermined specific design of an electrical plug such as the plug P, as shown in FIG. 6. After the plug puller 10 is placed over the prongs A,B,C, the plug P is inserted into an outlet O in the usual manner, as shown in FIG. 3. As with the plug puller 10 shown in FIGS. 1, 2 and 3, the overall length of the plug puller 30 is 38 cm, with a width through the center of 6.5 cm, a width through the hand hold openings 12, 14 of 9 cm and a thickness of approximately 2 mm (1/16 in). The single central opening 36 is a square with 3 cm sides.

Figure 7:
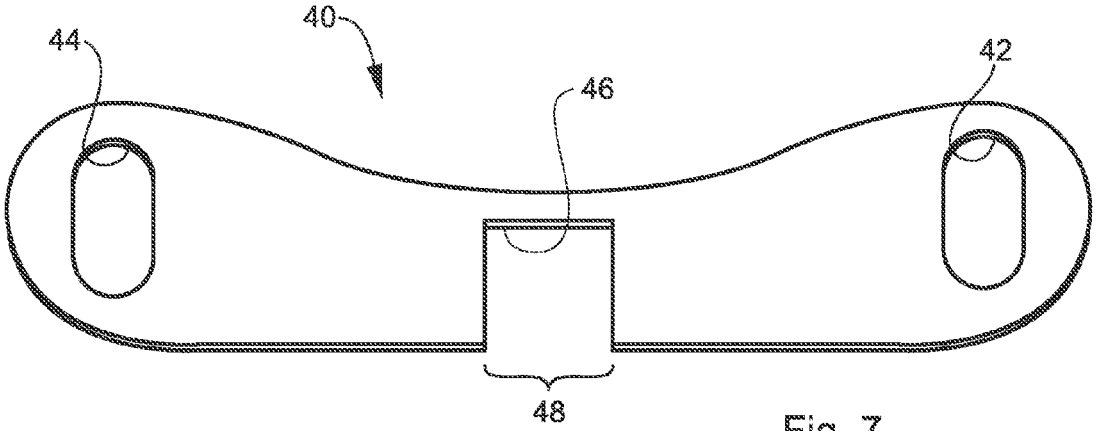
FIG. 7 is a plan view of another embodiment of a plug puller according to one embodiment of the invention.

Referring now to FIG. 7, another alternate plug puller is shown at reference numeral 40, and is fabricated from a length of flexible dielectric material. One suitable material is high density polyethylene (HDPE) sheet material, as with the plug pullers 10 and 30 of FIGS. 1 and 5. The plug puller 40 includes a pair of finger hold openings 42, 44 near the opposite ends, and a central opening 46 spaced equally between the finger hold openings 42, 44. The opening 46 is sized and spaced to fit around the prongs A, B and C of a predetermined specific design of an electrical plug such as the plug P, as shown in FIG. 6. After the plug puller 10 is placed over the prongs A, B, C, the plug P is inserted into an outlet O in the usual manner, as shown in FIG. 3. As with the plug puller 10 shown in FIGS. 1, 2 and 3, the overall length of the plug puller 30 is 38 cm, with a width through the center of 6.5 cm, a width through the hand hold openings 12, 14 of 9 cm and a thickness of approximately 2 mm (1/16 in). The single central opening 46 is a square with 3 cm sides. The bottom of the opening 36 forms a notch 48 that communicates with the bottom edge of the plug puller 40.

Plug puller 40 therefore need not be left between the plug P and the outlet O during use. Instead, a single plug puller 40 is wedged downwardly from above the outlet O in between an outlet O and the plug P. When in place, the plug P can be pulled away from the outlet O in the usual manner. The 2 mm (1/16 in) thickness of the plug puller 40 is sufficiently strong to permit withdrawal of the plug P notwithstanding the notch 46 at the bottom.

Various shapes, dimensions and materials may be used rather than the specific shapes disclosed as preferred embodiments in this application. In all of the embodiments disclosed above, the material from which the plug pullers is fabricated is sufficiently flexible to easily be moved into the position shown in FIG. 4, but when released, slowly returns to the position shown in FIG. 3. The plug pullers remain in the FIG. 3 position at all times except when the plug is being removed as shown in FIG. 4.

A plug puller according to the invention has been described with reference to specific embodiments and examples. Various details of the invention may be changed without departing from the scope of the invention. Furthermore, the foregoing description of the preferred embodiments of the invention and best mode for practicing the invention are provided for the purpose of illustration only and not for the purpose of limitation, the invention being defined by the claims.

I claim:

1. A plug puller for removing an electrical plug from an outlet, comprising:

(a) an elongate sheet of flexible dielectric material defining first and second opposing ends;

(b) grasping elements proximate the first and second opposing ends of the elongate sheet;

(c) at least one plug opening positioned between the opposing ends for being placed around prongs of the electrical plug and held in place on the plug while the plug is inserted in the outlet; and (d) the opposing ends adapted for being moved between a first position extended outwardly away from each other and a second, removal position with the opposing ends folded towards each other for being grasped and pulled away from the outlet to remove the plug;

(e) wherein the plug opening comprises a single opening sized and shaped to fit over and surround the prongs of a plug having complementary sized and shaped prongs, and further wherein the plug opening communicates with one edge of the plugpuller to form a notch, and is adapted to be wedged between the plug and the outlet when the plug is to be removed.

2. A plug puller according to claim 1, wherein the elongate sheet of flexible dielectric material comprises high density polyethylene.

3. A plug puller according to claim 1, wherein the grasping elements comprise respective finger hold openings formed in the elongate sheet.

4. A plug puller according to claim 1, wherein the elongate sheet of flexible dielectric material comprises high density polyethylene having a thickness of approximately 2 mm.

5. A plug puller according to claim 1, wherein the elongate sheet is about 38 cm long, 6.5 cm wide at its center and 9 cm wide at its widest points proximate the opposing ends.

* * * * *